US005806438A

United States Patent [19]

Beaudet

[11] Patent Number: 5,806,438

[45] Date of Patent: Sep. 15, 1998

[54] ADJUSTABLE SHELF SYSTEM

[75] Inventor: David A. Beaudet, Oak Park Heights, Minn.

[73] Assignee: Kwik-File, Inc., Fridley, Minn.

[21] Appl. No.: 832,959

[22] Filed: Apr. 4, 1997

Related U.S. Application Data

[63] Continuation of Ser. No. 516,145, Aug. 17, 1995, abandoned.

[51] Int. Cl.[6] ..... A47B 9/14

[52] U.S. Cl. ..... 108/107; 108/110; 108/144.11; 211/187

[58] Field of Search ..... 108/107, 110, 108/106, 144, 193, 153; 211/186, 187, 190, 208

[56] References Cited

U.S. PATENT DOCUMENTS

| | | | |
|---|---|---|---|
| 1,030,472 | 6/1912 | Krag | 108/110 |
| 1,059,464 | 4/1913 | Hine | 211/187 X |
| 1,764,131 | 6/1930 | Walter | 108/110 |
| 3,481,485 | 12/1969 | Hess . | |
| 3,807,572 | 4/1974 | Luvara et al. | 211/187 X |

FOREIGN PATENT DOCUMENTS

| | | | |
|---|---|---|---|
| 5538 | 1/1895 | United Kingdom | 108/107 |
| 18698 | 3/1912 | United Kingdom | 211/147 |
| 222045 | 9/1924 | United Kingdom | 108/110 |
| 897152 | 5/1962 | United Kingdom | 108/107 |

OTHER PUBLICATIONS

Kwik–File, The Office Organizers.
Kwik–File, Price List and Specification Book, Feb. 1, 1989.
Kwik–File, The Insertables.
Kwik–File, Mailflow Systems.
Kwik–File, Specification Guide.

*Primary Examiner*—Peter M. Cuomo
*Assistant Examiner*—Hanh V. Tran
*Attorney, Agent, or Firm*—Merchant, Gould, Smith, Edell, Welter & Schmidt, P.A.

[57] ABSTRACT

An adjustable shelf system is disclosed having vertical left and right end panels, one or more center panels, top and bottom panels for holding the end panels and center panels in spaced relation and a back panel. A plurality of shelves may be adjustably positioned at various levels between the end panels and center panels. Each of the end panels and center panels is formed with support loops that are interlockably engaged by insertable tabs formed on the left and right sides of each shelf. Alignment tabs on each shelf side defined common left and right lower edges that guide the shelf into its proper position during assembly and subsequent re-positioning. The support loops on opposed vertical panels (e.g., the left end panel and the center panel) are structurally different and unique to the left and right sides of the shelf, respectively, so that the shelf can be insertably mounted in only a single orientation and at the proper depth within the shelf system.

21 Claims, 4 Drawing Sheets

ADJUSTABLE SHELF SYSTEM

This is a Continuation of application Ser. No. 08/516,145, filed Aug. 17, 1995, abandoned.

BACKGROUND OF THE INVENTION

The invention broadly relates to adjustable shelf systems and is specifically directed to a shelf system in which each of a plurality of shelves can be quickly and easily mounted in an desired horizontal position.

Adjustable shelf systems are well established in the prior art and are usable in a wide variety of applications. In the field of office equipment, adjustable shelf systems that have a plurality of vertical shelf support panels and a plurality of shelves that can be adjustably positioned between the shelf support panels are particularly useful for sorting, arranging, organizing, storing and the like. The overall objective is to arrange a wide variety of items in a highly efficient manner enabling quick access and retrieval.

Adjustable shelf systems that are currently available include left and right end panels held in vertical spaced relation between top and bottom panels. A back panel is optional, providing a closed back system when it is used and an open system when excluded. One or more central panels may be used that are selectively positioned between the left and right end panels in desired upright positions, and shelves of different width and depth can be adjustably placed at differing levels within the respective end panels and central panels.

Such adjustable shelf support systems enable the user to select a wide variety of components and configurations resulting in compartmented organizing space to fit the user's needs. However, the user of a conventional system often encounters difficulty in properly installing and orienting the shelf from front to back and side to side. Specifically, in prior art shelf systems, the mechanical interconnection between the shelf sides and support panels can permit the shelf to be misaligned on one side relative to the other or misaligning the shelf from front to back, either of which results in a shelf that is not horizontal. It is also possible to misorient the shelf so that its rear edge is reversed with the forward edge. In other prior art shelf systems, there is no interlocking structure between the shelf sides and shelf support panels, permitting the shelf to be inadvertently moved. Further, in many systems the shelves are loosely fitting and rattle relative to the vertical panels.

The inventive adjustable shelf system is specifically intended to overcome these difficulties and problems. It includes left and right end panels, top and bottom panels and one or more central panels in a manner similar to conventional systems. However, structural means are included on the shelf sides and panels that ensure that the shelf will be inserted and mounted only in a horizontal position. This is accomplished by providing a continuous shelf guiding edge or rail on each side of the shelf that guides it into its proper position.

These structural interlocking means also establish a unique relationship between the left side of the shelf and left supporting panel and a different unique relationship between the right shelf side and right supporting panel. This prevents the shelf from being misoriented when it is insertably mounted and also ensures that only a shelf of proper size will be mounted between vertical panels corresponding in size.

The structural relationships between the shelves and shelf supporting panels result in a shelf system that is capable of handling a variety of shelves of differing width and depth, while ensuring that each shelf can be guidably inserted into its proper position and installed in only a single correct position. The initial assembly of the adjustable shelf system is therefore more easily accomplished by the user, as are subsequent adjustments of the various shelves. Last, because each shelf interlocks with each of its vertical supporting panels, the assembly is stronger and much more resistant to rattling.

DESCRIPTION OF THE PREFERRED EMBODIMENTS

Figure 1:
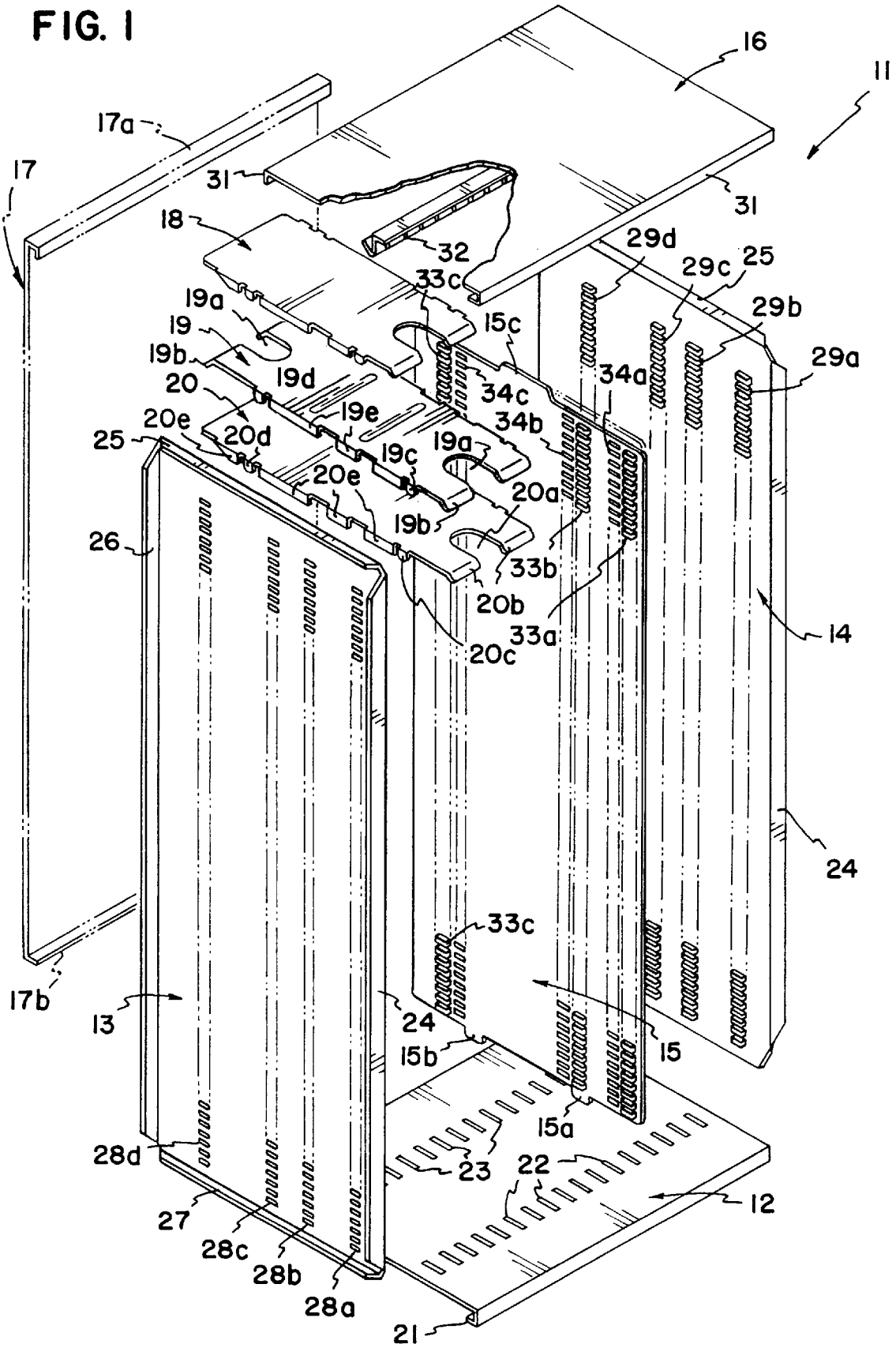
FIG. 1 is an exploded perspective view of a shelf support system embodying the invention.

With initial reference to FIG. 1, an adjustable shelf system is represented generally by the numeral 11. This embodiment, which is referred to as a closed back system, includes a bottom panel 12 that server as a panel support means for left and right end shelf support panels 13, 14, a central shelf support panel 15, a top panel 16, a back panel 17 and a plurality of adjustably positioned support shelves 18, 19 and 20. Back panel 17 is optional, and when excluded the system 11 is referred to as an open back system in which access to the shelves is from either the front or back of the system. Shelves 18, 20 are typically used in the closed back system and shelf 19 is used in the open back system.

All of the components 12–20 of FIG. 1 are preferably formed from metal plate and fabricated by die stamping, and bending or other fabricating techniques.

With continued reference to FIG. 1, bottom panel 12 is rectangular with forward and leading edges formed with a double downward bend to define front and rear elongated support legs 21 (only the front leg is shown in FIG. 1) The weight of the adjustable shelf system 11 is carried in part by the support legs 21. Bottom panel 12 also includes front and rear rows of slots 22, 23. These rows are disposed in parallel relation from the left to the right side of bottom panel 12, and preferably are equidistantly spaced from its front and rear edges. Each of the slots 22, 23 is elongated from front to back, and the lateral spacing between the slots is preferably one inch.

Each of the end panels 13, 14 is rectangular in configuration with top, bottom and side edges bent outwardly to define elongated tabs 24–27. End panels 13, 14 are respectively welded to the left and right ends of bottom panel 12 with the bottom tabs 27 in planar alignment with the support legs 21 to complete the bottom support for the shelf system 11. End panels 13, 14 are preferably disposed in parallel relation.

End panel 13 includes four vertical rows of inwardly projecting shelf support loops 28*a*–*d*. End panel 14 includes similar rows of inwardly projecting shelf support loops 29*a*–*d*. As discussed in further detail below, all of the loops are of identical configuration, but the loop rows of end panels 13, 14 are spaced differently for a purpose disclosed below.

Figure 6:
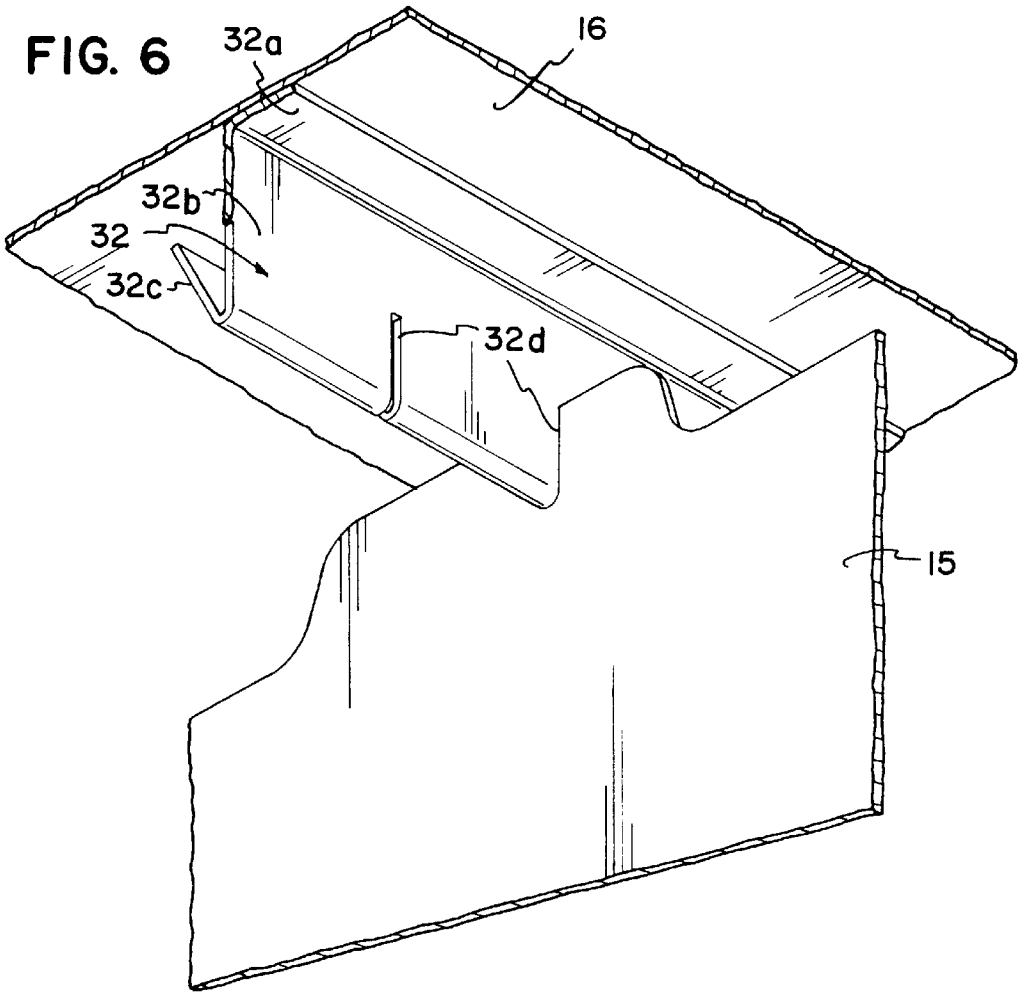
FIG. 6 is an enlarged fragmentary perspective view of the interrelationship between a center shelf support panel and top of the shelf support system.

Top panel 16 is rectangular in shape and has the same dimensions as bottom panel 12. It also has double bended forward and rearward edges 31, and the end panels 13, 14 are respectively welded to its left and right sides. With references to both FIGS. 1 and 6, a support member 32 for center panel 15 is attached to the underside of top panel 16 extending from its left to its right side. Specifically, a horizontally bent elongated tab 32*a* is welded to the underside of top panel 16. A downwardly projecting vertical leg 32*b* and an angular leg 32*c* define a V-shaped configuration in which a plurality of slots 32*d* are formed. The slots 32*d* are also preferably spaced one inch apart, and they are spaced in planar alignment with the slots 22, 23 of bottom panel 12.

Back panel 17 is rectangular in configuration and sized to the dimension of panels 12, 13, 14 and 16. It includes a double bent upper edge 17*a* and a single bent lower edge 17*b*. Back panel 17 is welded to the rear edges of panels 12, 13, 14 and 16.

It will be appreciated that the length and width of panels 12, 13, 14 and 16 (and optional back panel 17) together define the overall size of the shelf system 11, and each of these components (as well as the other components of the system as described below) can be manufactured in different lengths and widths to produce adjustable shelf systems 11 varying in size depending on specific requirements.

Center panel 15 is also of rectangular configuration and is vertically disposed in parallel alignment with the end panels 13, 14. Center panel 15 includes a pair of downwardly projecting feet 15*a,b* that are positioned for insertion into selected slots 22, 23 of bottom panel 12. Center panel 15 also includes an upwardly projecting tab 15*c* that is disposed for insertion into one of the slots 32*d* of support member 32. Center panel 15 is not permanently affixed but rather can be adjustably placed in a selected position over the width of shelf support system 11. The height of center panel 15 together with the tabs 15*a–c* are such that tab 15*c* may first be inserted into a selected slot 32*d* and the panel 15 lifted as it slides rearward until the feet 15*a,b* are located over the appropriate slots 22, 23, at which time the panel 15 drops into place with the upper tab 15*c* remaining in the selected slot 32*d*.

Center panel 15 includes 3 vertical rows of shelf support loops that project toward end panel 13, which bear reference numerals 33*a–c*. Three rows of shelf support loops 34*a–c* project toward end panel 14.

It is necessary to provide two sets of support loops 33*a–c*, 34*a–c* on central panel 15 because of the manner in which the loops constructed. With momentary reference to FIG. 5, which is an enlarged fragmentary view showing one of the loops 33*b* and one of the loops 34*b*, each loop is formed by die stamping the panel 15 so that the impacted portion is partially severed along parallel lines and then outwardly bent to form a shallow rectangular loop. From the manufacturing standpoint, the formation of such support loops is relatively simple, but this approach practically precludes the rows of loops 33*b*, 34*b* from being disposed in direct alignment on opposite sides of the central panel 15. It would be possible to form the various shelf support loops by forming each loop from a strip of material and securing it to the panel face in the proper position, which would enable the rows of loops 33*b*, 34*b* to be disposed in direct opposition. However, this manufacturing approach takes considerably more time and material, and is much more expensive. The die stamping approach is simple, far less expensive and provides loops that are structurally strong for the intended purpose, which is to support adjustably placed shelves through the use of insertable shelf tabs as discussed below.

It is structurally possible to dispose the rows of support loops 33*a–c*, 34*a–c* on central panel 15 in direct opposition to the support loop rows 28*a–d* of end panel 13 and support loops 29*a–d* of end panel 14, respectively. If this were done, the insertable tabs of each of the adjustable shelves (as discussed below) would be identically placed on each side of the shelf. However, one of the features of the adjustable shelf system 11 is to ensure that each shelf is placed with the proper end oriented to the front (if the shelf is reversible), and also so that it is placed in a perfectly horizontal position (i.e., it is not staggered from side to side or from front to back by insertion into support loops at different levels). It is also important that selected shelves which may have a depth less than the width of the end panels 13, 14 be placed appropriately. The unique placement of rows of shelf support loops on the end panels 13, 14 and the central panel 15 ensures simple, quick placement of each shelf in a horizontal position and at the correct depth within the overall unit. This is accomplished by forming vertical rows of loops on each of the end and central panels that are spaced to uniquely correspond to the spacing of insertable tabs on each side of the shelves. The rows of loops of each of the end panels 13, 14 also accommodate one side of each of the shelves, notwithstanding shelves of differing depth. Also, the depth of a particular shelf corresponds to the depth or width of an associated central panel.

This is best understood by considering the specific example of shelf 20, which in the preferred embodiment is 15 inches in depth. Shelf 20 is specifically intended to be used with the central panel 15, which also has a depth or width of 15 inches. As shown in FIG. 1, shelf 20 is a generally flat, rectangular metal plate the forward end of which is formed with a rounded recess 20*a* and a pair of leading tabs 20*b* that are angled downward. The recess 20*a* facilitates the insertion and removal of file material. Tabs 20*b* are adapted to receive labels. The rear edge of shelf 20 is straight and is adapted for use with back panel 17 in a closed back system.

The left side of shelf 20 (i.e., the shelf nearest end panel 13) is formed with a pair of downwardly projecting, rounded insertable tabs 20*c*, 20*d*. Each of the tabs of shelf 20 (and the tabs of all other shelves) is sized and configured to fit into an associated shelf supporting loop in the manner shown in FIG. 5. Tab 20*c* is positioned so that, with the rear edge of shelf 20 adjacent the back panel 17, it is insertable into a selected one of the row of support loops 28*a* (the first support loop). Tab 20*d* is spaced from tab 20*c* so that it is insertable into a selected shelf support loop 28*d* (the second support loop) at the same level.

Also on the left side of shelf 20 are several downwardly bent alignment tabs 20*e* that, together with insertable tabs 20*c,d* define an elongated lower edge for the shelf the purpose of which is described in further detail below. The spaces between the tabs 20*e* are placed to accommodate the other rows of support loops 28*b,c*.

Figure 5:
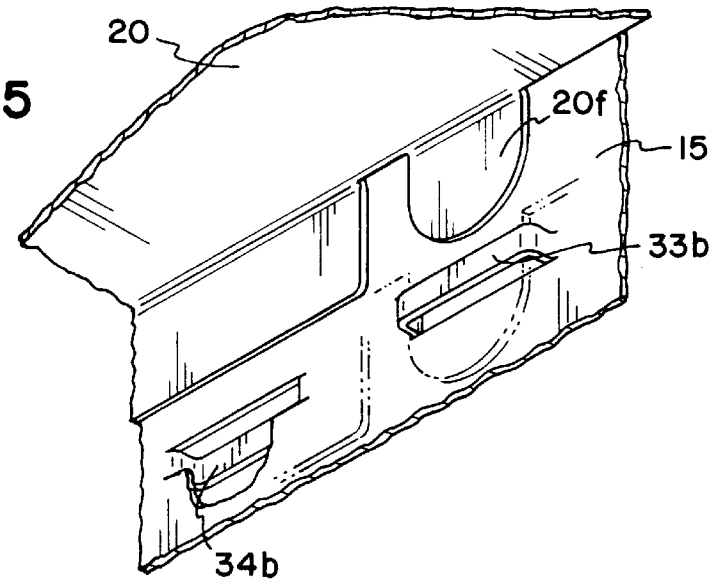
FIG. 5 is an enlarged fragmentary perspective view showing the interlocking relationship between a horizontal shelf and vertical shelf support.

The opposite side of shelf 20 includes insertable tabs 20*f,g* (only tab 20*f* is seen in FIG. 5). Tab 20*f* is disposed for insertion into a selected loop 33*a* the third support loop) in central panel 15, and tab 20*g* is insertable into a selected loop 33*c* (the fourth support loop) at the same level. Shelf 20 also includes downwardly projecting alignment tabs 20*h* therefore tabs on its right side that correspond to the tabs 20*e*.

The foregoing description assumes that shelf 20 is to be placed between the left end panel 13 and central panel 15. Since the central panel 15 and shelf 20 are matched by virtue of their depth, the shelf 20 may also be placed between the central panel 15 and right end panel 14. Under such circumstances, the insertable tab 20*c* fits into one of the loops 34*a* (the first support loop) and tab 20*d* inserts into one of the support loops 34*c* (the second support loop) at the same level. Tab 20*e* inserts into one of the support loops 29*a* (the third support loop and tab 20*f* inserts into a support loop 29*d*, (the fourth support loop) all at the same level.

The alignment tabs 20*e* on the left side of shelf 20 and the corresponding alignment tabs 20*h* on its right side facilitate placement of the shelf 20. Specifically, the user chooses a selected height for the shelf 20 and the rear edge is inserted into the space or slot above the associated loops. The rear most alignment tab 20*e* is angled as shown in FIG. 1 (the corresponding alignment tab 20*h* on the right side is similarly angled), which facilitates sliding movement of the shelf 20 over the first row of inwardly projecting loops on each side. This guides the shelf so that the lower edge of the left tabs 20*c,d,e* and the lower edge defined by right tabs 2*f,g,h* slide on top of the inwardly projecting loops. This accomplishes two important functions. First, the shelf 20 is guided into the chosen slot and it is impossible for one side of the shelf to drop or to be raised into the support loops of a lower or higher row. As such, the shelf 20 will be horizontal both side to side and front to back when it is finally mounted. Second, the insertable tabs 20*c,d,f,g* determine the proper position of depth of shelf 20, and when they reach their associated support loops the shelf 20 drops into place. This ensures that shelf 20 will be placed at the proper depth relative to the end panels 13, 14 and the selected panel central 15.

It would be appreciated that the angled alignment tabs 23*e,h* at the rear of shelf 20 are staggered lengthwise of the shelf 20. However, the corresponding support loops on the opposed end panels or selected center panels are similarly staggered from the standpoint of depth, and the angled alignment tabs 20*e,h* therefore engage these associated support loops simultaneously, ensuring a smooth insertion of the shelf 20 as it slides rearwardly toward its installation position.

Further, it will be noted that the shelf 20 includes a rear edge 20*i* that projects rearward of the angled alignment tabs 20*e–h*. The provision of the rear edge 20; 20*i* without insertable or alignment tabs permits the shelf 20 to be properly inserted between the vertically spaced support loops that define the slot in which the shelf 20 is to be inserted. In other words, inserting the rear edge 20*i* or tail portion of the shelf into the appropriate slot between support loops establishes the initial reference point for the shelf, after which it is smoothly guided, transitioning upward due to the angled alignment tabs 20*e,h* until the insertable tabs 20*c,d* and 20*f–g* fall into the associated support loops.

Figure 3:
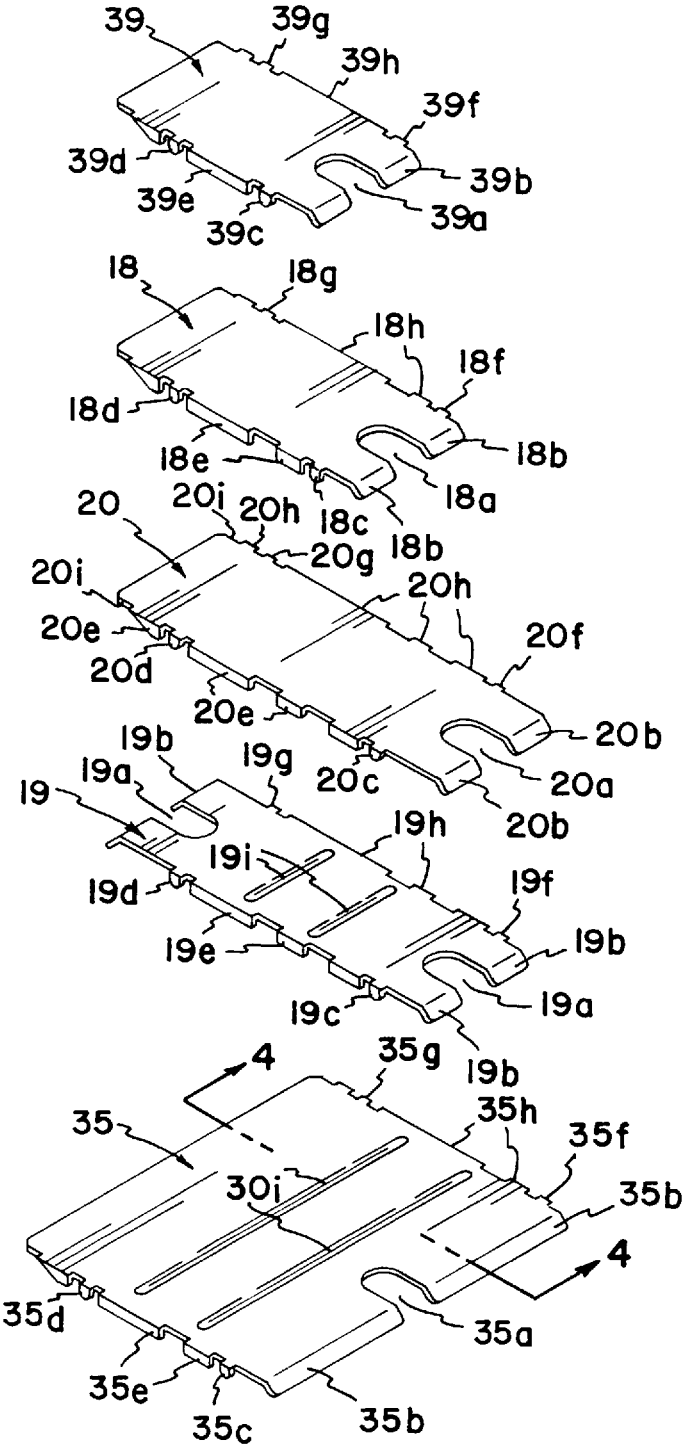
FIG. 3 is a perspective view of alternative shelves.
Figure 4:
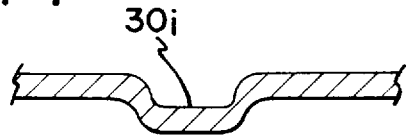
FIG. 4 is an enlarged fragmentary sectional view taken along the line 4—4 of FIG. 3.

With reference to FIG. 3, a shelf 35 corresponds in structure to the shelf 20 with two exceptions. First, it is much wider (e.g., 15 inches), which necessitates the placement of central panel 15 in a corresponding position of width, and it includes two strengthening ribs 30*i*. These strengthening ribs 30*i* are shown in the enlarged fragmentary sectional view of FIG. 4. They are preferably formed by die stamping to define a shall depression over a substantial portion of the width of shelf 35. The structure of shelf 35 is otherwise the same as shelf 20, and similar reference numerals represent the various tabs and recess.

Figure 2:
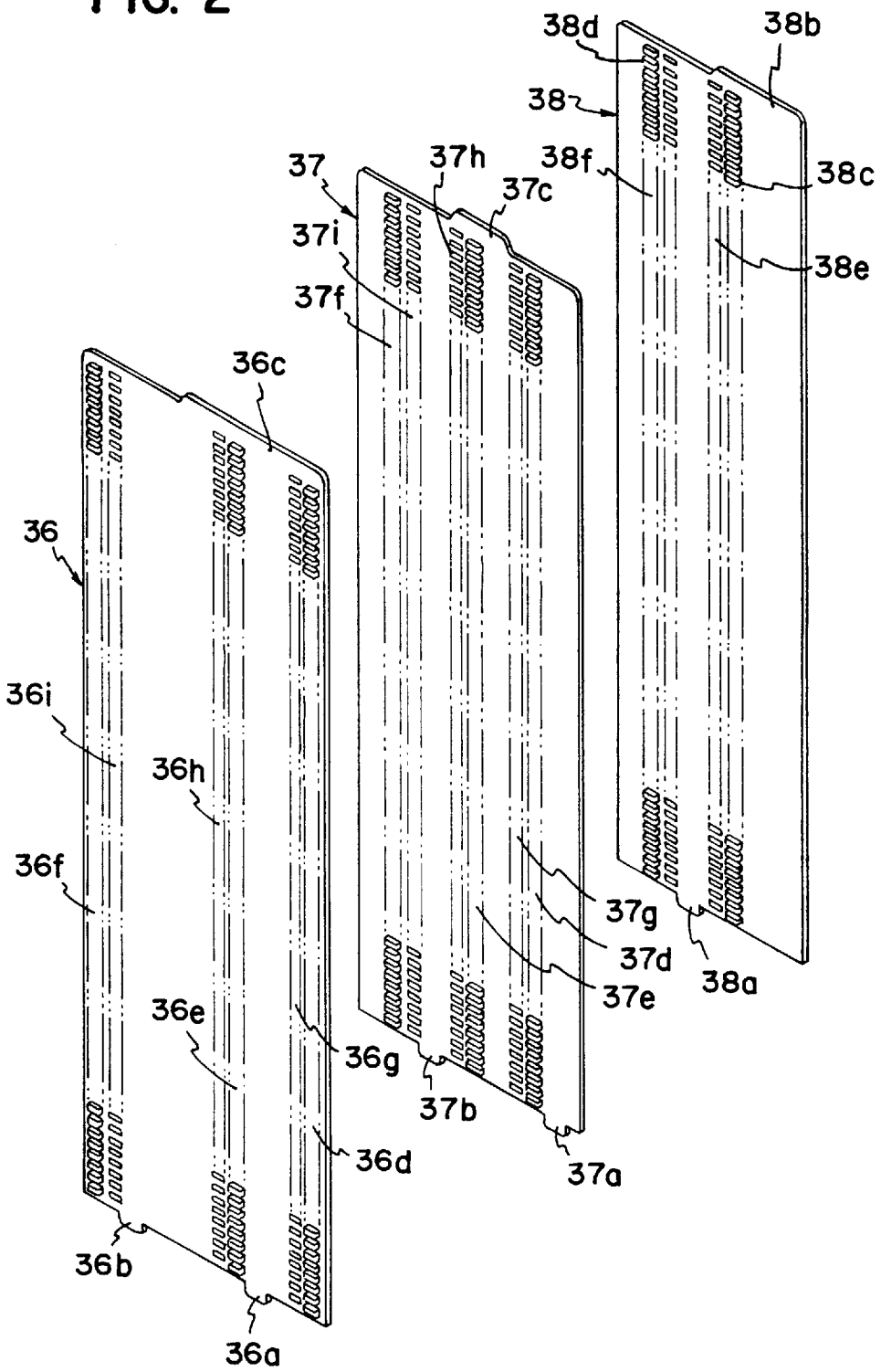
FIG. 2 is a perspective view of alternative center panel shelf supports for the shelf support system.

FIG. 2 discloses alternative central panels 36–38. Panel 36 includes feet 36*a,b* that fit into selected aligned slots 22, 23, and a large upwardly projecting tab 36*c* enables the panel 36 to be used in an open back system; i.e., one which does not include the back panel 17. Panel 36 is formed with vertical rows of left projecting shelf support loops 36*d,e,f* and vertical rows of right projecting loops 36*g,h,i*. It is preferably 14 inches in depth.

Central panel 37 includes feet 37*a,b* and an upwardly projecting tab 37*c* for use in a closed back system (similar to central panel 15). It is formed with rows of left hand support loops 37*d,e,f* and rows of right hand projecting support loops 37*g,h,i*. In the preferred embodiment, panel 37 has a depth of 12 inches.

Central panel 38 has a single foot 38*a* that fits into a selected slot 23. An upwardly projecting tab 38*b* enables its use in an open back system. Central panel 38 has rows of left projecting support loops 38*c,d* and rows of right projecting loops 38*e,f*. Central panel 38 is preferably 10 inches in depth.

With continued reference to FIGS. 1–3, shelf 19 is preferably 14 inches in depth and is therefore intended for use with central panel 37. It has identical rounded recesses 19*a* and angled tabs 19*b* at each end. On its left side are insertable tabs 19*c,d* and alignment tabs 19*e*. On the right side are insertable tabs 19*f,g* and alignment tabs 19*h*. Depending on its width, shelf 19 may include ribs 19*i*.

When shelf 19 is to be disposed between left end panel 13 and central panel 36, tab 19*c* is inserted into a selected loop 28*a* and tab 19*d* is inserted into a selected loop 28*d* at the same level. Right hand loop 19*f* fits into a loop 33*a* and tab 19*g* fits into a loop 33*c*, all at the same level.

With continued reference to FIGS. 1–3, shelf 18 is 12 inches in depth and is used with central panel 37. It includes a recess 18*a* and angled tabs 18*b*, left insertable tabs 18*c,d*, right insertable tabs 18*f,g*, left alignment tabs 18*e* and right alignment tabs 18*h*. Left insertable tab 18*c* fits into a selected loop 28*b* of left end panel 13, and insertable tab 18*d* fits into a selected loop 28*d*. Insertable tabs 18*c,d* may also fit into support loops 37*g,i*, respectively, of central panel 37. Right insertable tabs 18*f,g* may fit into the loops 37*d,f*, respectively, of central panel 37, or loops 29*b,d*, respectively, of right end panel 14.

A shelf 39 is 10 inches in depth and corresponds to central panel 38. It includes a recess 39*a*, angled tabs 39*b*, left insertable tabs 39*c,d*, right insertable tabs 39*f,g*, left alignment tabs 39*e* and right alignment tabs 39*h*. Insertable tabs 39*c,d* fit into loops 28*c,d*, respectively of left end panel 13, or loops 38*e,f* of central panel 38. Right insertable tabs 39*f,g* can fit into the loops 38*c,d*, respectively, of central panel 38, or loops 29*c, d*, respectively of right end panel 14.

Based on the various structural and dimensional alternatives discussed above, an adjustable shelf system 11 may have a closed or open back and may be of a wide variety of sizes. The overall size of a system 11 is determined by its intended function, which in turn depends on the number and size of the shelves. With these specifications in mind, an overall dimension is determined and a system 11 is assembled by welding left and right end panels 13, 14 to bottom and top panels 12, 16, and optional back panel 17 is included or excluded. With the overall width established the number of central panels 15, 36, 37 or 38 is determined as a function of the number and width of shelves, and the chosen central panel or panels are placed as described above; i.e., the upper projecting tab is aligned in an upper slot 32*d* and the selected panel is slid rearwardly until the panel feet drop into the appropriate slots 22, 23. Shelves of appropriate width and number are then chosen and placed as described above; i.e., the rear edge of each shelf is initially inserted at a chosen level and the alignment tabs of the shelf guide it until its insertable tabs drop into the appropriate support loops on each side. The insertable tabs and alignment tabs together cause the associated shelf to be firmly positioned without rattling. The assembly 11 is completed when all shelves are properly inserted between the respective end and central panels.

What is claimed is:

1. An adjustable shelf system comprising:

left and right shelf supporting panel means;

panel support means holding the left and right panel means in spaced, upright relation;

first and second support loop means disposed in laterally spaced relation on the left panel means;

third and fourth support loop means disposed in laterally spaced relation on the right panel means;

shelf means of predetermined length and width having left, right, front and rear sides;

first and second insertable tab means on the left side of the shelf means and constructed and arranged for interlockable insertion into the first and second support loop means, respectively;

third and fourth insertable tab means on the right side of the shelf means and constructed and arranged for interlockable insertion into the third and fourth support loop means, respectively;

first alignment tab means on the left side of the shelf means, the first alignment tab means extending from a point proximate the rear side of the shelf means over a substantial portion of its length and defining a common lower left shelf edge for said shelf means; and second alignment tab means on the right side of the shelf means, the second alignment tab means extending from a point proximate the rear side of the shelf means over a substantial portion of its length and defining a common lower right shelf edge for said shelf means;

at least one of said first and second alignment tab means being disposed rearwardly of its associated insertable tab means and defining a ramp-like surface to facilitate entry of the shelf means relative to the associated support loop means;

said insertable tab means and alignment tab means being constructed and arranged to guide the shelf means relative to said support loop means as it is inserted between said panel means and to permit interlockable engagement of the respective insertable tab means and support loop means only when the shelf means is in its proper position between the panel means.

2. The adjustable shelf system defined by claim 1, wherein the shelf means defines a substantially horizontal shelf surface, and the respective insertable tab means and alignment tab means project downward in substantially perpendicular relation to said horizontal shelf surface.

3. The adjustable shelf system defined by claim 1, wherein the first, second, third and fourth support loop means are disposed in substantially horizontal relation.

4. The adjustable shelf system defined by claim 3, wherein the spacing between the first and second support loop means is different than the spacing between the third and fourth support loop means so that the shelf means can be interlockably positioned in only a single orientation.

5. The adjustable shelf system defined by claim 1, wherein the first, second, third and fourth support loop means each comprises a substantially vertical row of support loops with the support loop means within the respective vertical rows being identically vertically spaced and horizontally aligned so that the shelf means can be adjustably mounted in any of a plurality of horizontal positions.

6. The adjustable shelf system defined by claim 1, wherein the panel support means comprises top panel support means and bottom panel support means.

7. The adjustable shelf system defined by claim 6, wherein the top and bottom panel support means are secured to the left and right panel means.

8. The adjustable shelf system defined by claim 7, which further comprises back panel means secured to the top and bottom panel support means and the left and right panel means.

9. The adjustable shelf system defined by claim 1, which comprises at least one center panel means carried by the panel support means in upright relation between the left and right panel means.

10. The adjustable shelf system defined by claim 1, wherein each of said shelf supporting panel means comprises additional support loop means to accommodate shelf means of different size, and each of said first and second alignment tab means comprises a plurality of separate alignment tabs spaced apart to accommodate said additional support loop means.

11. The adjustable shelf system defined by claim 1, which further comprises:

center panel means having right and left sides and held by said panel support means in spaced, upright relation between the left and right end panel means, the center panels means having left and right faces;

fifth and sixth support loop means disposed on the right face of the center panel means in a laterally spaced relation corresponding to that of the first and second support loop means;

and seventh and eighth support loop means disposed on the left face of the center panel means in a laterally spaced relation corresponding to that of the third and fourth support loop means.

12. The adjustable shelf means defined by claim 1, wherein both of said first and second alignment tab means are disposed rearwardly of their associated insertable tab means, each defining a ramp-like surface to facilitate entry of the shelf means relative to its associated support loop means.

13. The adjustable shelf system defined by claim 12, wherein each of said ramp-like surfaces comprises a straight angled ramp.

14. An adjustable shelf system comprising:

left and right shelf supporting panel means;

panel support means holding the left and right panel means in spaced, upright relation;

first, second and third support loop means disposed in laterally spaced relation on the left panel means;

fourth, fifth and sixth support loop means disposed in laterally spaced relation on the right panel means;

shelf means sized to fit between the left and right panel means; the shelf means having left and right sides;

first and second insertable tab means on the left side of the shelf means and constructed and arranged for interlockable insertion into a selected two of said first, second and third support loop means;

third and fourth insertable tab means on the right side of the shelf means and constructed and arranged for interlockable insertion into a selected two of the fourth, fifth and sixth support loop means;

first alignment tab means on the left side of the shelf means, the first alignment tab means defining a common lower left shelf edge for said shelf means and comprising a plurality of separate alignment tabs spaced apart to accommodate said first, second and third support loop means;

second alignment tab means on the right side of the shelf means, the second alignment tab means defining a common lower right shelf edge for said shelf means and comprising a plurality of separate alignment tabs spaced apart to accommodate said fourth, fifth and sixth support loop means; and said insertable tab means and alignment tab means being constructed and arranged to guide the shelf means relative to said support loop means as it is placed between said panel means and to permit interlockable engagement of the respective insertable tab means and selected support loop means only when the shelf means is in its proper position between the panel means.

15. An adjustable shelf system comprising:

left and right shelf supporting panel means;

panel support means holding the left and right panel means in spaced, upright relation;

first and second support loop means disposed in laterally spaced relation on the left panel means;

third and fourth support loop means disposed in laterally spaced relation on the right panel means;

shelf means of predetermined length and width having left, right, front and rear sides;

first and second insertable tab means on the left side of the shelf means and constructed and arranged for interlockable insertion into the first and second support loop means, respectively;

third and fourth insertable tab means on the right side of the shelf means and constructed and arranged for interlockable insertion into the third and fourth support loop means, respectively;

first alignment tab means on the left side of the shelf means, the first alignment tab means defining a common lower left shelf edge for said shelf means;

second alignment tab means on the right side of the shelf means, the second alignment tab means defining a common lower right shelf edge for said shelf means; and each of said alignment tab means comprising angled alignment tab means disposed rearwardly of said insertable tab means, said angled alignment tab means defining an angled, ramp-like surface to facilitate guided entry of the shelf means relative to said support loop means.

16. The adjustable shelf system defined by claim 15, wherein the first, second, third and fourth support loop means each comprises a substantially vertical row of support loops with the vertical rows being identically vertically spaced and horizontally aligned so that the shelf means can be adjustably mounted in any of a plurality of horizontal positions, and said shelf means comprises a rear edge projecting rearwardly of said angled alignment tab means to facilitate guided entry of said shelf between selected vertically spaced support loop means.

17. The adjustable shelf system defined by claim 15, wherein said angled tab means comprises an angled alignment tab on each side of said shelf means.

18. The adjustable shelf system defined by claim 17, wherein the spacing between the first and second support loop means is different than the spacing between the third and fourth support loop means so that the shelf means can be interlockably positioned in only a single orientation, and said angled alignment tabs are disposed in accordance with the spacing between the first and second support loop means and the third and fourth support loop means, respectively, wherein said angled alignment tabs engage said support loops substantially simultaneously upon insertion of said shelf means.

19. An adjustable shelf system comprising:

left and right shelf supporting panel means;

panel support means holding the left and right panel means in spaced, upright relation;

first and second support loop means disposed in laterally spaced relation on the left panel means;

third and fourth support loop means disposed in laterally spaced relation on the right panel means;

shelf means of predetermined length and width having left, right, front and rear sides;

first and second insertable tab means on the left side of the shelf means and constructed and arranged for interlockable insertion into the first and second support loop means, respectively;

third and fourth insertable tab means on the right side of the shelf means and constructed and arranged for interlockable insertion into the third and fourth support loop means, respectively;

first alignment tab means on the left side of the shelf means, the first alignment tab means extending from a point rearward of said first and second insertable tab means and proximate the rear side of the shelf means over a portion of its length and defining a common lower left shelf edge for said shelf means; and second alignment tab means on the right side of the shelf means, the second alignment tab means extending from a point rearward of said third and fourth insertable tab means and proximate the rear side of the shelf means over a portion of its length and defining a common lower right shelf edge for said shelf means;

at least one of said first and second alignment tab means being disposed rearwardly of its associated insertable tab means and defining a ramp-like surface to facilitate entry of the shelf means relative to the associated support loop means;

said insertable tab means and alignment tab means being constructed and arranged to guide the shelf means relative to said support loop means as it is inserted between said panel means and to permit interlockable engagement of the respective means and to permit interlockable engagement of the respective insertable tab means and support loop means only when the shelf means is in its proper position between the panel means.

20. The adjustable shelf system defined by claim 19, wherein both of first and second alignment tab means are disposed rearwardly of their associated insertable tab means, each defining a ramp-like surface to facilitate entry of the shelf means relative to its associated support loop means.

21. The adjustable shelf system defined by claim 20, wherein each of said ramp-like surfaces comprises a straight angled ramp.

* * * * *